US007398953B2

(12) United States Patent
Anderson

(10) Patent No.: US 7,398,953 B2
(45) Date of Patent: Jul. 15, 2008

(54) ONE WAY VALVE FOR FLUID EVACUATION FROM A CONTAINER

(75) Inventor: Brent Anderson, Barrington, IL (US)

(73) Assignee: CTI Industries, Inc., Barrington, IL (US)

( * ) Notice: Subject to any disclaimer, the term of this patent is extended or adjusted under 35 U.S.C. 154(b) by 496 days.

(21) Appl. No.: 11/020,380

(22) Filed: Dec. 22, 2004

(65) Prior Publication Data

US 2006/0131339 A1 Jun. 22, 2006

(51) Int. Cl.
*F16K 31/44* (2006.01)

(52) U.S. Cl. ..... 251/82; 383/66; 383/100

(58) Field of Classification Search ..... 251/77, 251/82, 331; 383/66, 100, 103
See application file for complete search history.

(56) References Cited

U.S. PATENT DOCUMENTS 2,772,692 A * 12/1956 Russell ..... 137/223
2,778,173 A 1/1957 Taunton
3,949,934 A 4/1976 Goglio
4,756,422 A 7/1988 Kristen
5,067,208 A 11/1991 Herrington, Jr. et al.
5,088,971 A 2/1992 Herrington
5,131,121 A 7/1992 Herrington, Jr. et al.
5,161,286 A 11/1992 Herrington, Jr. et al.
5,203,458 A 4/1993 Cornwell
5,332,095 A * 7/1994 Wu ..... 206/524.8
5,442,837 A 8/1995 Morgan
5,450,963 A 9/1995 Carson
5,701,996 A 12/1997 Goto et al.
5,836,056 A 11/1998 Porchia et al.
5,924,173 A 7/1999 Dobreski et al.
5,931,189 A * 8/1999 Sweeney et al. ..... 137/512.15
5,950,285 A 9/1999 Porchia et al.
6,010,244 A 1/2000 Dobreski et al.
6,033,113 A 3/2000 Anderson
6,036,364 A 3/2000 Heuvel
6,071,011 A 6/2000 Thomas et al.
6,074,096 A 6/2000 Tilman
6,092,931 A 7/2000 Tilman
6,131,248 A 10/2000 Tomic
6,145,810 A * 11/2000 Connolly et al. ..... 251/331
6,152,600 A 11/2000 Tomic
6,156,363 A 12/2000 Chen et al.
6,161,271 A 12/2000 Schreiter
6,164,826 A 12/2000 Petkovsek
6,199,256 B1 3/2001 Revnew et al.
6,210,038 B1 4/2001 Tomic
6,217,215 B1 4/2001 Tomic
6,231,236 B1 5/2001 Tilman (Continued)

FOREIGN PATENT DOCUMENTS

EP 1 431 211 A1 6/2004

(Continued)

*Primary Examiner*—John K Fristoe, Jr.
(74) *Attorney, Agent, or Firm*—Joseph A. Fuchs; Rockey, Depke & Lyons, LLC

(57) ABSTRACT

The present invention provides a one way valve having a valve body, a wall, a fluid inlet, and a fluid outlet. The valve has a plunger which is moveable with respect to the valve body from a first position to a second position. The valve also has a diaphragm positioned in the valve body for movement between a third position and a fourth position when the plunger is in the first position. When the diaphragm is in the third position the fluid outlet is closed and when the diaphragm is in the fourth position the fluid outlet is open.

6 Claims, 6 Drawing Sheets

U.S. PATENT DOCUMENTS 6,247,843 B1 6/2001 Buchman
6,247,844 B1 6/2001 Tomic et al.
6,264,366 B1 7/2001 Custer
6,273,607 B1 8/2001 Buchman
6,286,999 B1 9/2001 Cappel et al.
6,287,000 B1 9/2001 Buchman
6,287,001 B1 9/2001 Buchman
6,290,390 B1 9/2001 Buchman
6,290,391 B1 9/2001 Buchman
6,290,393 B1 9/2001 Tomic
6,306,071 B1 10/2001 Tomic
6,327,754 B1 12/2001 Belmont et al.
6,347,885 B1 2/2002 Buchman
6,357,915 B2 3/2002 Anderson
6,361,209 B1 3/2002 LaRue et al.
6,361,211 B1 3/2002 Tilman
6,364,530 B1 4/2002 Buchman
6,376,035 B1 4/2002 Dobreski et al.
6,386,760 B1 5/2002 Tomic
6,402,375 B1 6/2002 Schreiter et al.
6,409,066 B1 6/2002 Schneider et al.
6,409,384 B1 6/2002 Provan et al.
6,419,391 B2 7/2002 Thomas
6,439,770 B2 8/2002 Catchman
6,450,686 B1 9/2002 May
6,461,042 B1 10/2002 Tomic et al.
6,467,956 B1 10/2002 Tilman et al.
6,470,551 B1 10/2002 Provan et al.
6,474,866 B2 11/2002 Buchman
6,481,890 B1 11/2002 VandenHeuvel et al.
6,491,432 B2 12/2002 May
6,499,878 B1 12/2002 Dobreski et al.
6,517,242 B1 2/2003 Buchman
6,524,002 B2 2/2003 Tomic
6,527,444 B1 3/2003 Buchman
6,533,456 B1 3/2003 Buchman
6,572,266 B2 6/2003 Buchman
6,575,625 B2 6/2003 Cappel et al.
6,594,872 B2 7/2003 Cisek
6,595,486 B2 * 7/2003 Chen ..... 251/82
6,604,634 B2 8/2003 Su
6,609,353 B1 8/2003 McMahon et al.
6,612,002 B1 9/2003 Savicki
6,622,353 B2 9/2003 Provan et al.
6,663,283 B1 12/2003 Cappel
6,686,005 B2 2/2004 White et al.
6,698,926 B2 3/2004 Buchman
6,709,157 B2 3/2004 VandenHeuvel et al.
6,712,334 B2 * 3/2004 Motonaka et al. ..... 251/149.6
6,712,509 B2 3/2004 Cappel
6,712,510 B2 3/2004 Schneider et al.
6,713,152 B2 3/2004 Chen et al.
6,715,187 B1 4/2004 Wang
6,733,622 B2 5/2004 McMahon et al.
6,743,330 B2 6/2004 Crevier
6,751,932 B1 6/2004 Matthews
6,796,015 B2 9/2004 Cortigiano, Sr.
6,799,680 B2 10/2004 Mak
6,804,935 B2 10/2004 Schneider et al.
6,810,639 B1 11/2004 McMahon et al.
6,810,641 B2 11/2004 Ausnit
6,810,642 B2 11/2004 Cortigiano, Sr.
6,811,528 B1 11/2004 Chen
6,817,763 B2 11/2004 Tomic
6,821,589 B2 11/2004 Dobreski et al.
6,840,675 B2 1/2005 Knight
6,840,897 B2 1/2005 Knight
6,842,973 B2 1/2005 Share et al.
6,843,600 B2 1/2005 Tilman et al.
6,846,108 B2 1/2005 Buchman
6,846,544 B2 1/2005 Buchman
6,854,887 B2 2/2005 Anderson
6,863,645 B2 3/2005 Crunkleton et al.
6,866,420 B2 3/2005 Buchman
6,874,298 B2 4/2005 McMahon et al.
6,874,937 B2 4/2005 Ausnit
6,880,972 B2 4/2005 Plourde
6,880,973 B2 4/2005 Schneider et al.
6,883,210 B1 4/2005 Savicki
6,884,208 B2 4/2005 Haws
6,895,725 B2 5/2005 Cortigiano, Sr.
6,896,409 B2 5/2005 Plourde et al.
6,901,637 B2 6/2005 Machacek
6,902,091 B2 6/2005 Cortigiano, Sr.
6,904,735 B2 6/2005 McMahon et al.
6,948,849 B2 9/2005 Schreiter
7,008,106 B2 3/2006 Cappel
7,040,808 B2 5/2006 Rehwinkel et al.
2001/0053253 A1 12/2001 Buchman et al.
2002/0012479 A1 1/2002 Tomic
2002/0064320 A1 5/2002 May
2002/0064321 A1 5/2002 Schreiter
2002/0064322 A1 5/2002 May
2002/0076122 A1 7/2002 Buchman
2002/0090151 A1 7/2002 Skeens et al.
2002/0117215 A1 8/2002 Skeens
2002/0196987 A1 12/2002 Tilman et al.
2003/0021499 A1 1/2003 Buchman
2003/0063820 A1 4/2003 Buchman
2003/0169949 A1 9/2003 Buchman
2003/0185945 A1 10/2003 Buchman
2003/0202718 A1 10/2003 Tomic
2003/0202720 A1 10/2003 VandenHeuvel et al.
2003/0223654 A1 12/2003 Gerrits
2003/0228075 A1 12/2003 Buchman
2004/0022461 A1 2/2004 Schreiter
2004/0037477 A1 2/2004 Buchman
2004/0086206 A1 5/2004 Tomic
2004/0091179 A1 5/2004 Anderson
2004/0120610 A1 6/2004 Buchman
2004/0131283 A1 7/2004 Sprague et al.
2004/0136615 A1 7/2004 Tilman et al.
2004/0136617 A1 7/2004 Gerrits
2005/0036717 A1 2/2005 Wu et al.
2005/0036718 A1 2/2005 Wu et al.
2005/0036719 A1 2/2005 Wu et al.
2005/0063617 A1 3/2005 Tilman
2005/0063621 A1 3/2005 Kettner et al.
2005/0135710 A1 6/2005 Melchoir
2005/0147330 A1 7/2005 Lee
2005/0244084 A1 11/2005 Tilman et al.
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2006/0003879 A1 1/2006 Buchman
2006/0029301 A1 2/2006 Schreiter
2006/0029302 A1 2/2006 Buchman
2006/0072854 A1 4/2006 Schreiter
2006/0104548 A1 5/2006 Schreiter
2006/0110079 A1 5/2006 Zimmerman et al.
2006/0133700 A1 6/2006 Cappel
2006/0171610 A1 8/2006 Buchman et al.
2006/0182371 A1 8/2006 Borchardt
2006/0193540 A1 8/2006 Borchardt

FOREIGN PATENT DOCUMENTS

JP 01-139346 5/1989
JP 09-131846 5/1997

* cited by examiner

ONE WAY VALVE FOR FLUID EVACUATION FROM A CONTAINER

CROSS-REFERENCE TO RELATED APPLICATION

Not Applicable.

FEDERALLY SPONSORED RESEARCH OR DEVELOPMENT

Not Applicable.

BACKGROUND OF THE INVENTION

1. Technical Field

The present invention relates to collapsible containers for storing compressible articles, such as linen and clothing, and in particular to evacuable storage containers.

2. Background Art

Collapsible, evacuable storage containers typically include a flexible, fluid-tight bag, an opening through which to place an article in the bag, and a fixture through which to evacuate excess air. A user places an article into the enclosure through the opening, seals the opening, and then evacuates the fluid through the fixture. With the chamber thus evacuated, the article contained therein may be significantly compressed, so that it is easier to transport and requires substantially less storage space.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

One such container was developed by James T. Cornwell (U.S. Pat. No. 5,203,458). That patent described a disposable, evacuable container for sealing and compressing contaminated surgical garments for ease of storage and transportation prior to disposal.

Another such enclosure is described in a patent to Akihiro Mori and Ichiro Miyawaki (Japanese Pat. No. 01-139346). In that device, the opening through which the stored article is placed requires the application of a heat source, such as a home iron, to form an effective seal.

These and other aspects and attributes of the present invention will be discussed with reference-to the following drawings and accompanying specification

BRIEF DESCRIPTION OF THE DRAWINGS

FIG. 5 is a top view of an embodiment of a plunger of the present invention;

Figure 1:
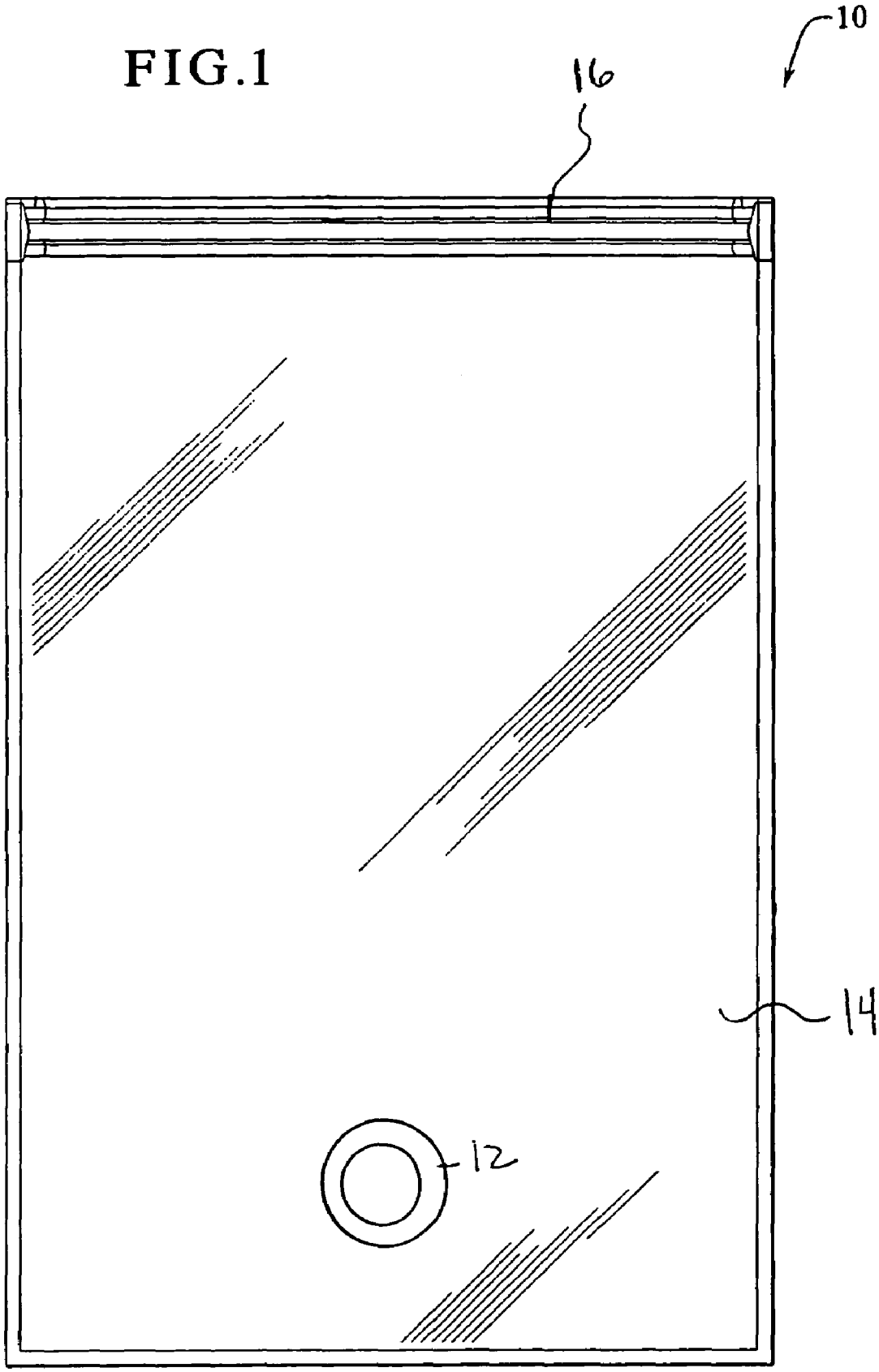
FIG. 1 is a perspective view of a container and closure assembly of the present invention with the container being in a sealed position.

DETAILED DESCRIPTION OF THE INVENTION:

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
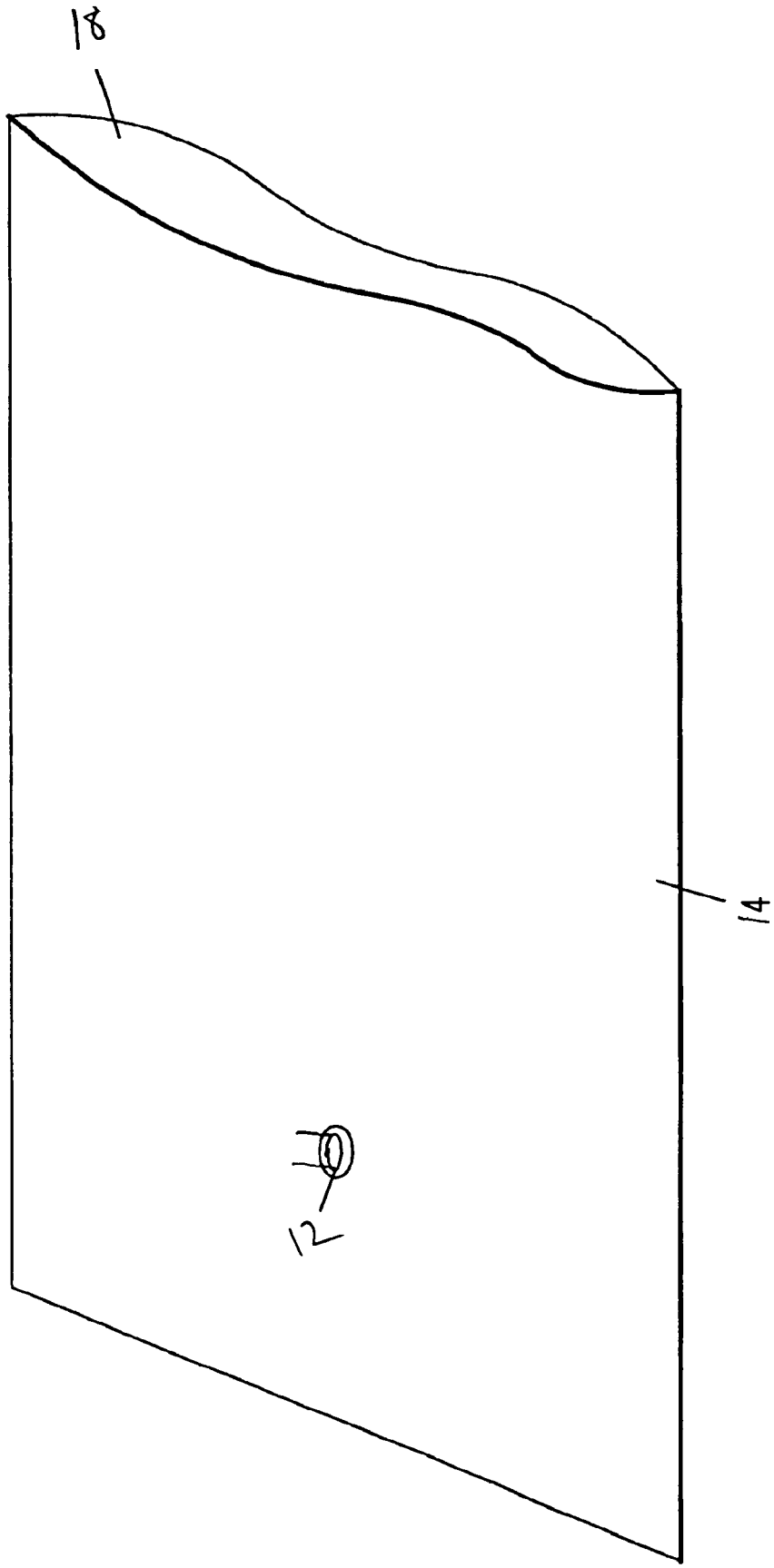
FIG. 2 is a perspective view of a container and closure assembly of the present invention with the container being in an unsealed position.

FIGS. 1 and 2 show a container system 10 having a closure assembly 12 and a container 14. The closure assembly includes a one-way valve that allows for evacuation of fluid from the container but does not allow a significant quantity of fluid to enter the container through the assembly 12. In one preferred form of the invention the container 14 is capable of being opened and closed repeatedly without the use of a tool or heat source by utilizing a zipper 16 or other member for sealing an end of the container. FIG. 2 shows the container in an unsealed position with an opening 18 at an end of the container for loading articles into the container. The container is suitable for storing compressible articles sealed from the surrounding environment and maintaining a fluid tight seal. Excess fluid in the container can be removed by applying a suction to the closure assembly using a household vacuum cleaner or other suction device. Removal of excess fluid reduces the size of the compressible article and by maintaining a minimal fluid content, such as air and water, inhibits the growth of insects, mold, mildew and other bacteria, which may damage the contents of the container. Moreover, in a preferred form of the invention, the sealed container and closure assembly provide a barrier to the passage of fluids to further inhibit the growth and propagation of bacteria, mold and mildew among other organisms over an extended period of time.

Figure 3:
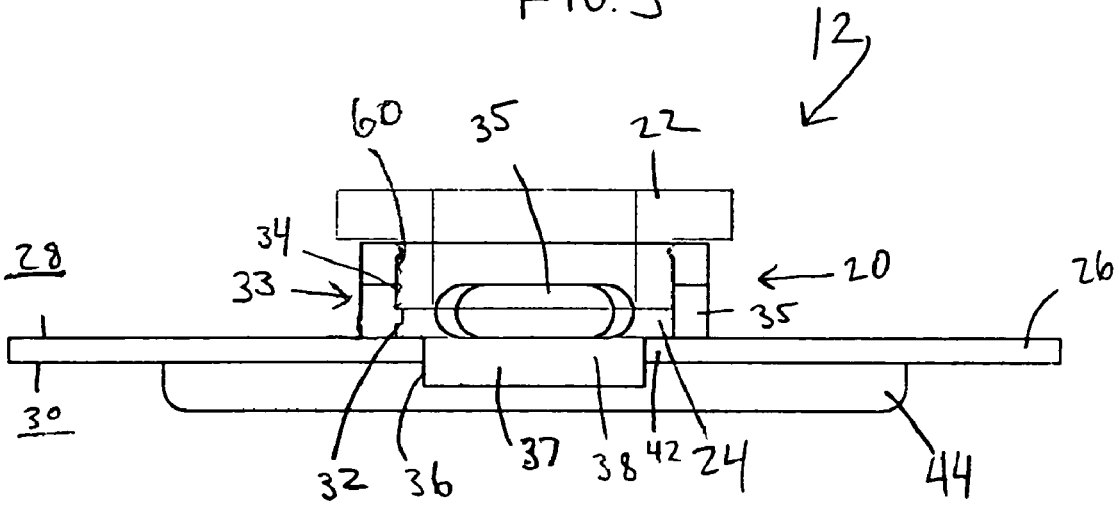
FIG. 3 is a cross-sectional view of an embodiment of a valve of the present invention in a closed position.
Figure 4:
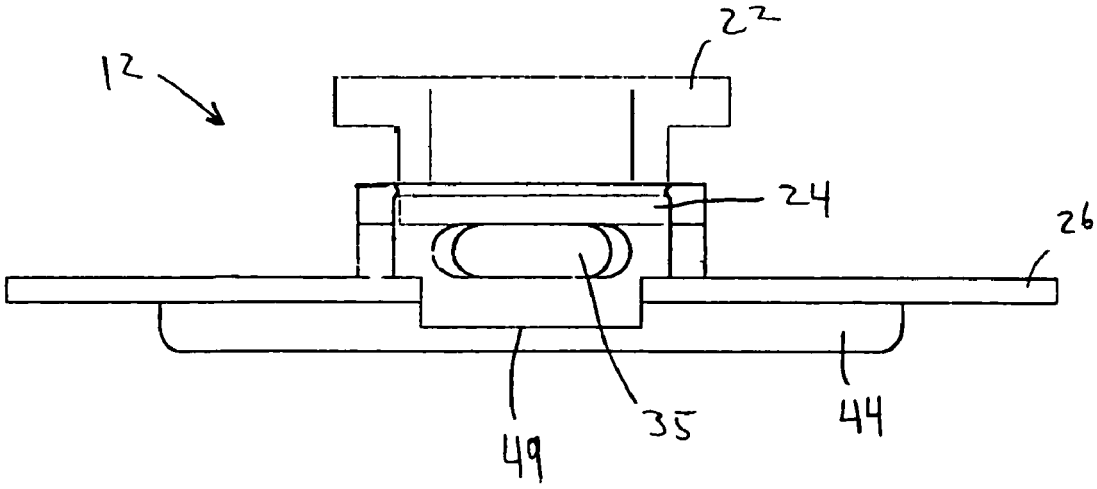
FIG. 4 is a cross-sectional view of an embodiment of a valve of the present invention in an open position.
Figure 4:
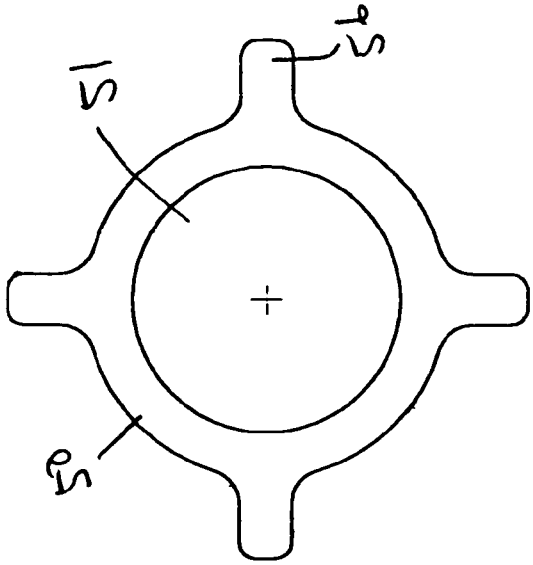

FIGS. 3 and 4 show the closure assembly 12 having a valve body 20, a plunger 22 and a diaphragm 24. FIG. 3 shows the closure assembly 12 in a first, closed position and FIG. 4 shows the closure assembly in a second, open position. The valve body 20 has an annular flange 26 having a first surface 28 and an opposed second surface 30, a centrally disposed opening 32 through the flange, and a cylindrical wall 33 extends from the first surface and is disposed circumjacent the opening 32 and defines a first fluid pathway 34 therethrough. The first cylindrical wall has a plurality of circumferentially spaced openings 35.

Figure 8:
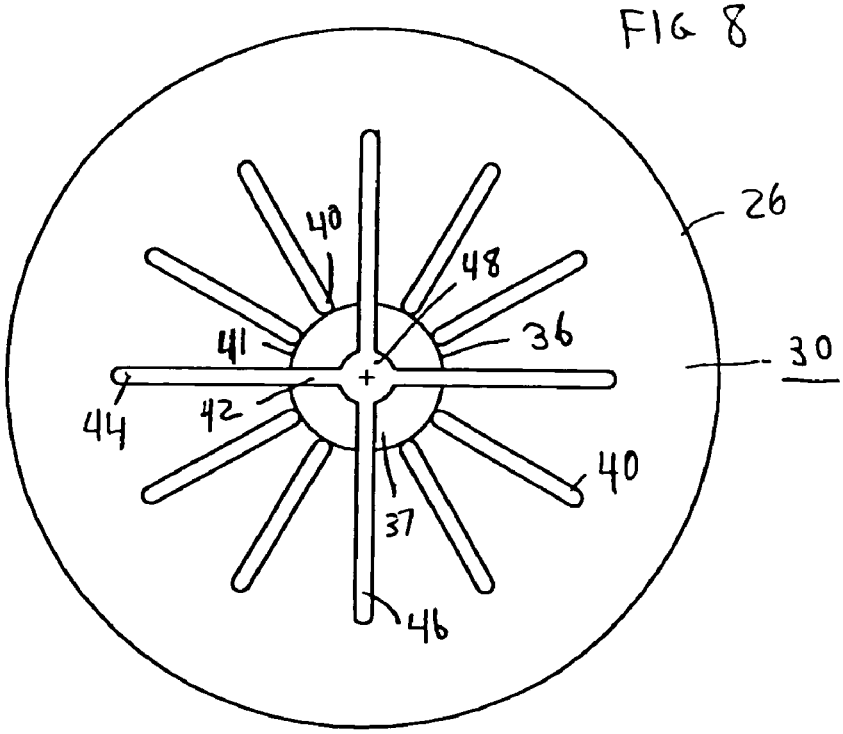
FIG. 8 is a bottom view of a valve of the present invention.

A second cylindrical wall 36 extends from the second surface 30 and has a fluid inlet 37 at a distal end and defines a second fluid pathway 38 therethrough that is in fluid communication with the opening 32. The fluid inlet 37 is sealed by the diaphragm 24 when the closure assembly is in the closed position and is uncovered when the closure assembly is in the open position. The second cylindrical wall 36 is circumferentially surrounded by a plurality of radially extending and circumferentially spaced fins 39 (See also FIG. 8) each of which have an end 40 terminating at an outer periphery 41 of the second cylindrical wall 36.

A valve supporting surface 42 is positioned in a generally central portion of the second fluid passageway and has a generally cruciform shaped member 43 having a first arm 44 a second arm 46 transverse to the first arm and has a generally circular platform 48 joining the first arm to the second arm. The valve supporting surface 42 extends across the entire diametrical dimension of the second cylindrical wall 36 and extends from the second surface 30 beyond a distal end 49 of the wall. The fins and the cruciform shaped member add rigidity to the valve assembly and reduce the tendency for the fluid inlet 37 to become closed or partially closed by the sidewalls of the container or by articles within the container.

In a preferred form of the invention the valve body 20 is fabricated from a polymeric material by an injection molding technique. Suitable polymeric materials for the valve body include polymers, copolymers and terpolymers fabricated from one or more chemical groups including olefins, dienes, amides, esters, vinyl chlorides, vinyl alcohols, vinyl acetates, urethanes, imides, ethers, sulfones, styrenes, acrylonitrile, acrylates, substituted acrylates, and blends of polymers, copolymers and terpolymers derived from these chemical groups. In one preferred form of the invention the valve body is fabricated from the terpolymer acrylonitrile-butadiene-styrene or from the homopolymer polypropylene, or from a copolymer of propylene with minor proportions, say less than 6% by weight, of ethylene.

Figure 6:
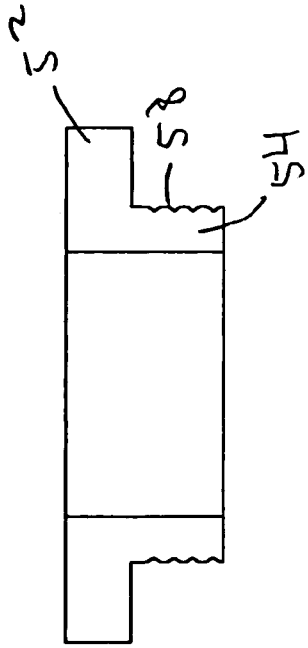
FIG. 6 is a side view of the plunger shown in FIG. 5.
Figure 7:
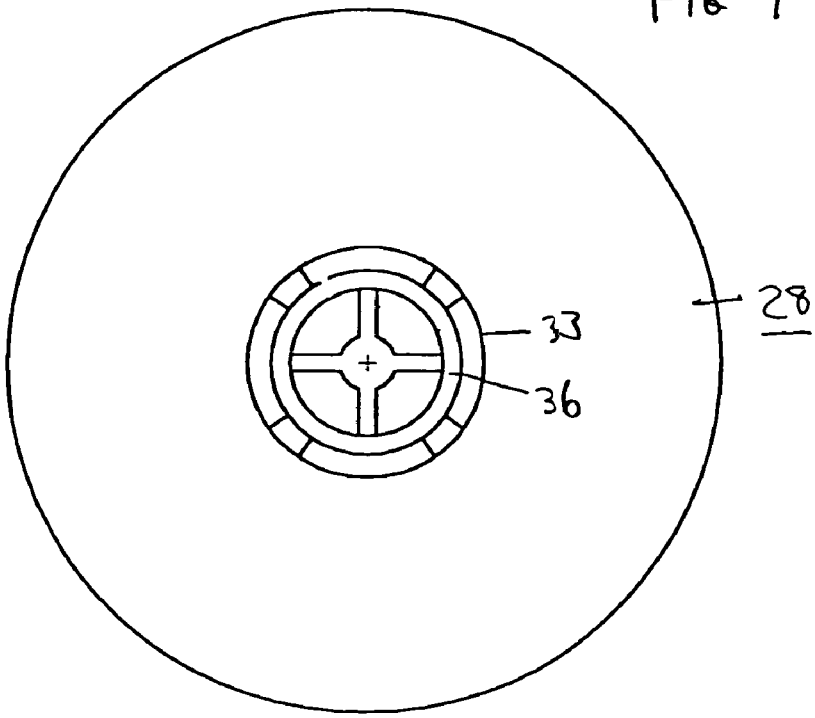
FIG. 7 is a top view of a valve of the present invention.

FIGS. 5 and 6 show the plunger 22 having a generally cylindrical shaped wall 50 defining a central fluid pathway 51. The plunger 22 has a flange portion 52 and a stem portion 54. FIG. 6 shows the flange portion includes several circumferentially spaced knobs 56 for hand gripping. The stem portion 54 extends coaxially within the valve body and has a set of threads 58 for cooperative engagement with mating threads 60 in the valve body 12. In a preferred form of the invention, the threads are coarse for moving the plunger between the first position shown in FIG. 3 to the second position shown in FIG. 4 with less than one complete 360° rotation of the plunger.

It is contemplated that instead of threads the plunger could have a flange or protuberance that would cooperatively engage a flange or protuberance in the valve body to allow the plunger to slide within the valve body without becoming disassembled. Such a plunger could be moved from the first position to the second position when a vacuum is applied. It is also contemplated there could be a first stop that releasably holds the plunger in the first position and a second stop that releasably holds the plunger in the second position.

Figures 9, 10:
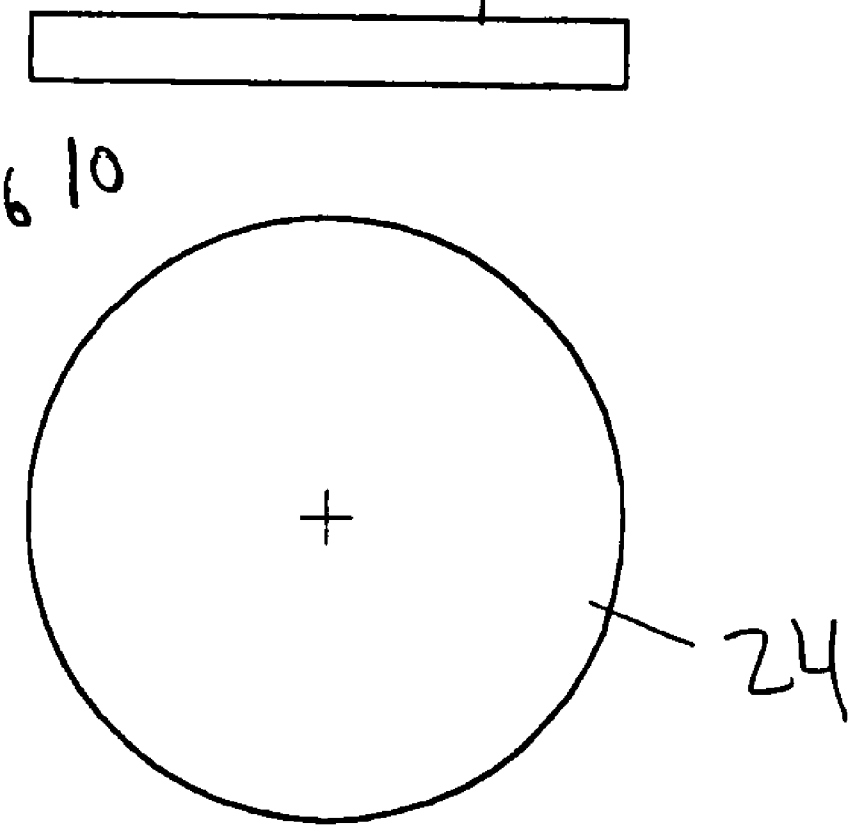
FIG. 9 is a side view of a diaphragm of the present invention.
FIG. 10 is a top view of a diaphragm of the present invention.

FIGS. 9 and 10 show the diaphragm 24 which is dimensioned to fit within the valve body and has a generally uniform thickness across its entire diametric dimension. The diaphragm is moveable from a third position to a fourth position, shown respectively in FIGS. 3 and 4, when the plunger is in the second position (FIG. 4). When the diaphragm is in the third position it cooperates with the plunger to block the fluid inlet 37 and when the diaphragm is in the fourth position fluid is allowed to flow through the fluid inlet 37 and the fluid passageways 35. The diaphragm is preferably fabricated from a material that has a density that allows it to be moved in response to a suction applied to the valve body. Suitable materials for the diaphragm include paper, plastic, rubber, cork or metal, in another preferred form of the invention, the diaphragm will have a density of less than about 1.2 g/cc. In yet another preferred form of the invention, the diaphragm will be fabricated from silicone or polyvinyl chloride.

In a preferred form of the invention, the zipper closure 16 is constructed in accordance with commonly assigned U.S. Pat. No. 6,033,113 or U.S. Patent Application No. 2004/0091179A1 each of which is incorporated herein by reference and made a part hereof. The zippered closure is typically made of plastic. Often associated with the zippered closure is a slider that facilitates sealing the zippered closure. The slider closes and can open the zippered closure. Examples of sliders include those disclosed in U.S. Pat. Nos. 6,306,071; 6,287,001; 6,264,366; 6,247,844; 5,950,285; 5,924,173; 5,836,056; 5,442,837; 5,161,286; 5,131,121; 5,088,971; and 5,067,208 each of which is incorporated herein by reference and made a part hereof.

The container 14 can be rigid, semi-rigid or flexible and, in a preferred form of the invention, should be capable of being sealed to form a fluid tight chamber. The container 14 can be permanently sealed or, as is shown in FIGS. 1 and 2, can be capable of being closed and reopened. What is meant by the term "flexible" is the material used to fabricate the container will have a mechanical modulus when measured according to ASTM D-882 of less than 40,000 psi. The term "semi-rigid" will refer to materials having a mechanical modulus of from 40,000 psi to 100,000 psi. The term "rigid" will refer to materials having a mechanical modulus of greater than 100,000 psi.

For containers that are permanently sealed fluid can be delivered to the container through an access member such as a tube, port, valve, spout, fitment or the like. The term "fluid" refers to liquids or gasses.

The container 14 can be fabricated from metal, paper, and plastic. Suitable plastics include the polymers set forth above for the valve body. The container can be fabricated from a monolayer film, a multiple layer film or from more than one ply of material where a portion of the plies are sealed together but the individual plies are not joined across their entire surface area. It is contemplated the container can be fabricated from a multiple layer structure having one or more layers of polymeric materials and one or more layers of paper or metals. Metals such as aluminum are known to provide significant barriers to water vapor transmission and to the transmission of gasses such as oxygen, nitrogen, helium, hydrogen and others. Also, polymers such as ethylene vinyl alcohol and polyamides are commonly used as they also provide significant barrier properties.

The container assembly 10 shown in FIGS. 1 and 2 includes the steps of providing a container, making a hole in the container dimensioned to fit the valve body 12, inserting the valve body 12 into the hole with the second surface 30 extending into the chamber of the container and the flange 26 contacting an outside surface of the container and providing heat directly or indirectly to the flange to weld the flange and valve body 12 to the container.

The container 14 can be evacuated of fluids by first moving the plunger from the first position to the second position either by rotating the plunger, sliding the plunger or the like, then applying a suction through a hose or the like using a household vacuum cleaner or other device such as a pump that is capable of generating a suction to remove fluid from the container through the valve body. Upon applying the suction the diaphragm is free to move from the third position to the fourth position where fluid can flow through the fluid passageways 35 and out of the container. After evacuation is complete the suction should be removed. The diaphragm will be moved by gravity or by a suction from the container to partially or fully close the fluid passageways 35. The plunger should then be moved back to the first position to maintain a fluid tight seal by locking the diaphragm in the third position.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A one way valve comprising:

a valve body having a wall, a fluid inlet, a fluid outlet, and a flange having opposed first and second surfaces and a centrally disposed opening through the flange, a first cylindrical wall extends from the first surface and is disposed circumjacent the opening, the first cylindrical wall having a fluid exit through the wall and in fluid communication with the opening, the flange having a second cylindrical wall extending from the second surface and defining a fluid passageway circumjacent the opening and in fluid communication therewith;

a valve supporting surface extends across a distal end of the second cylindrical wall and across the entire diametric dimension thereof;

a plunger associated with the valve body and moveable with respect to the valve body first position to a second position; and a diaphragm positioned in the valve body for movement between a third position and a fourth position when the plunger is in the first position, wherein when the diaphragm is in the third position the fluid outlet is closed and when the diaphragm is in the fourth position the fluid outlet is open.

2. The valve of claim 1 wherein the valve supporting surface comprises a first arm a second arm transverse to the first arm and a generally circular platform joining the first arm to the second arm.

3. The valve of claim 2 wherein the circular platform is disposed substantially centrally within the fluid passageway of the second cylindrical wall.

4. The valve of claim 3 wherein the valve supporting surface comprises a member extending across an axially portion of the annular wall.

5. The valve of claim 3 wherein the valve supporting surface comprises a generally cruciform shaped member extending across the opening.

6. The valve of claim 5 wherein the cruciform shaped member comprises a first arm, a second arm and a circular platform disposed in a central portion of the opening and connecting the first arm to the second arm.

* * * * *